US005904621A

United States Patent [19]

Small et al.

[11] Patent Number: 5,904,621

[45] Date of Patent: May 18, 1999

[54] ELECTRONIC GAME WITH INFRARED EMITTER AND SENSOR

[75] Inventors: David Bernard Small, San Jose; Brian Douglas Farley, Danville, both of Calif.; Jeffrey Jones, Highland Park, Ill.; Paul S. Rago, Pleasanton, Calif.

[73] Assignee: Tiger Electronics, Ltd., Pawtucket, R.I.

[21] Appl. No.: 09/008,347

[22] Filed: Jan. 16, 1998

Related U.S. Application Data

[63] Continuation-in-part of application No. 29/072,703, Jun. 25, 1997

[60] Provisional application No. 60/056,564, Aug. 21, 1997.

[51] Int. Cl.[6] ..... F41J 5/02

[52] U.S. Cl. ..... 463/52; 434/22; 463/53

[58] Field of Search ..... 403/49, 50, 51, 403/52, 53; 434/21, 22

[56] References Cited

U.S. PATENT DOCUMENTS

| | | | |
|---|---|---|---|
| Re. 33,229 | 6/1990 | Schwaber | 364/709 |
| D. 286,308 | 10/1986 | Mayer et al. | D21/146 |
| D. 303,130 | 8/1989 | Noble | D21/146 |
| D. 308,400 | 6/1990 | Ferri | D21/146 |
| D. 316,123 | 4/1991 | Shiung-Fei | D21/146 |
| 2,404,653 | 7/1946 | Plebanek . | |
| 2,957,693 | 10/1960 | Ross . | |
| 3,202,425 | 8/1965 | Van Hennik . | |
| 3,220,732 | 11/1965 | Pincus . | |
| 3,434,226 | 3/1969 | Schaller | 463/51 |
| 3,499,650 | 3/1970 | Lemelson . | |
| 3,508,751 | 4/1970 | Meyer et al. . | |
| 3,549,147 | 12/1970 | Katter et al. . | |
| 3,789,136 | 1/1974 | Haith et al. | 434/323 |
| 3,870,305 | 3/1975 | Harclerode | 463/50 |
| 3,898,747 | 8/1975 | Marshall | 463/51 |
| 3,960,380 | 6/1976 | Yokoi | 463/50 |
| 3,995,376 | 12/1976 | Kimble et al. | 434/22 |
| 4,164,081 | 8/1979 | Berke | 434/22 |
| 4,171,811 | 10/1979 | Meyer et al. | 463/52 |
| 4,266,776 | 5/1981 | Goldfarb | 463/5 |
| 4,267,606 | 5/1981 | Stelter et al. | 359/148 |
| 4,375,106 | 2/1983 | Voll | 359/148 |
| 4,426,662 | 1/1984 | Skerlos et al. | 348/734 |
| 4,533,144 | 8/1985 | Juarez et al. | 463/5 |
| 4,586,715 | 5/1986 | Scolari et al. | 463/50 |
| 4,629,427 | 12/1986 | Gallagher | 434/22 |
| 4,695,058 | 9/1987 | Carter, III et al. | 463/50 |
| 4,754,133 | 6/1988 | Bleich | 250/221 |
| 4,772,028 | 9/1988 | Rockhold et al. | 463/50 |

(List continued on next page.)

OTHER PUBLICATIONS

Laser Command™ product instructions, Astronomical Toys Ltd., Hong Kong, 1997 4 pages.

Laser Challenge™ product instructions, Toymax Inc., Westbury, New York, 1996, 4 pages.

Lase Pro 9000™ product package, Lewis Galoob Toys, Inc., South San Francisco, California, 1991, 6 pages.

*Primary Examiner*—Jessica J. Harrison
*Assistant Examiner*—James Schaef
*Attorney, Agent, or Firm*—Fitch, Even, Tabin & Flannery

[57] ABSTRACT

A hand-held electronic toy gun and target apparatus facilitating a game of tag using infrared light communications between a plurality of players. An electronic controller is coupled to a transmitter for sending a series of encoded infrared light signals and a receiver for detecting infrared light signals. A gun body enclosing the controller, transmitter and receiver combination includes a handle with at least one hand operable trigger and a housing atop the handle conforming to the player's wrist and forearm. The housing has a top portion for mounting a non-planar surface of a target window for exposing the target window upwardly and outwardly over a wide range of side angles. The housing further includes a front end portion forward of the handle for positioning an infrared light lens for focussing the series of encoded infrared light signals from the transmitter outwardly from the housing.

30 Claims, 11 Drawing Sheets

U.S. PATENT DOCUMENTS

| | | | |
|---|---|---|---|
| 4,781,593 | 11/1988 | Birge et al. | 434/22 |
| 4,802,675 | 2/1989 | Wong | 463/5 |
| 4,807,031 | 2/1989 | Broughton et al. | 348/460 |
| 4,808,143 | 2/1989 | Kuo | 446/406 |
| 4,844,475 | 7/1989 | Saffer et al. | 463/5 |
| 4,898,391 | 2/1990 | Kelly et al. | 463/5 |
| 4,931,028 | 6/1990 | Jaeger et al. | 446/225 |
| 4,938,483 | 7/1990 | Yavetz | 463/50 |
| 5,029,872 | 7/1991 | Sassak | 463/52 |
| 5,253,068 | 10/1993 | Crook et al. | 348/734 |
| 5,320,362 | 6/1994 | Bear et al. | 463/50 |
| 5,354,057 | 10/1994 | Pruitt et al. | 463/50 |
| 5,369,432 | 11/1994 | Kennedy | 348/181 |
| 5,375,847 | 12/1994 | Fromm et al. | 463/5 |
| 5,401,025 | 3/1995 | Smith, III et al. | 463/5 |
| 5,437,463 | 8/1995 | Fromm | 463/5 |
| 5,528,264 | 6/1996 | Kautzer et al. | 345/158 |
| 5,552,917 | 9/1996 | Darbee et al. | 359/148 |
| 5,577,962 | 11/1996 | Kounoe et al. | 463/49 |
| 5,656,907 | 8/1997 | Chainani et al. | 318/587 |
| 5,672,108 | 9/1997 | Lam et al. | 463/39 |
| 5,741,185 | 4/1998 | Kwan et al. | 463/52 |
| 5,788,500 | 8/1998 | Gerber | 463/51 |

ELECTRONIC GAME WITH INFRARED EMITTER AND SENSOR

CROSS-REFERENCES TO RELATED APPLICATIONS

The present invention is a continuation-in-part of U.S. provisional application No. 60/056,564, filed Aug. 21, 1997, and a continuation-in-part of U.S. design application Ser. No. 29/072,703, filed Jun. 25, 1997.

BACKGROUND OF THE INVENTION

1. Field of the Invention

This invention relates to electronic games and, more particularly, to a gun and target apparatus facilitating a game of tag using infrared light communications between a plurality of players. A gun body for an electronic controller, infrared light transmitter and receiver combination includes a handle with at least one hand operable trigger and a housing atop the handle conforming to the player's wrist and forearm. The housing has a top portion for mounting an arcuate target window exposed upwardly and outwardly over a wide range of side angles. The housing also includes a front end portion forward of the handle for positioning an infrared light lens for focussing a series of encoded infrared light signals from the transmitter outwardly from the housing. The receiver includes one or more photodiodes for detecting infrared light biased by an inductive current source presenting a substantially higher alternating current than direct current circuit impedance, which tends to limit current changes from abrupt changes in illumination to avoid driving the infrared receiver into saturation. Each transmitter provides a signature series of encoded infrared light signals substantially longer in duration than abrupt changes in the illumination from background noise to discriminate the encoded infrared signals from the background noise at said receiver.

2. Description of the Related Art

Prior art infrared electronic games have been available since about 1985. For example, one prior art infrared electronic game, sold beginning in about 1986 by WORLDS OF WONDER under the trademark LAZER TAG, permitted players to fire invisible beams at one another with each player being provided with a game unit for emission of an infrared light beam. In the WORLDS OF WONDER game, a target was affixed to each player in order to count the number of "hits" registered by the target associated with each player. In the WORLDS OF WONDER game, a player was tagged "out" when 6 hits were registered for that player.

Infrared games are communication devices using infrared light beams, operating on the same principle as a remote control for a television set or a videocassette recorder. Efforts have been made to operate prior art infrared games in the very harsh environment of direct and indirect sunlight, as well as in the environment of indoor lighting. These various environments have made it extremely difficult to reliably communicate from an emitting unit to a target. Numerous efforts have been made to deal with harsh lighting environments, with various techniques and varying degrees of success.

A need exists for infrared communication systems for use with electronic games having infrared emitters and sensors so as to better address the various lighting environments making it difficult to reliably communicate from an emitting unit to a target in a game setting. Additionally, it would be desirable to provide cost effective encoding of digital infrared signals to insure communication between various apparatus, and further to provide special features when communicating between these apparatus. An enhanced user interface for the players of such games may also find multiple input switches or triggers advantageous for providing multiple modes of play to make such game more interesting and challenging.

SUMMARY OF THE INVENTION

It is an object of the present invention to provide an infrared emitter and sensor that overcomes the disadvantages and problems of prior art electronic games using infrared transmitters and receivers.

It is another object of the invention to provide a gun apparatus for facilitating a game of tag using infrared light communications between a plurality of players.

It is another object of the invention to provide an apparatus for facilitating a game of tag using infrared light communications between a plurality of players, each player being equipped with the gun and target.

It is yet another object of the invention to provide a target apparatus for facilitating a game of tag using infrared light communications between a plurality of players.

It is a further object of the invention to provide a method of facilitating a game of tag using infrared light communications between a plurality of players.

An electronic game is described incorporating improved infrared communications to better discriminate encoded infrared signals from the background noise at the infrared receiver target, and enhanced game capabilities increase the interest in the game and the entertainment value for the players. A series of encoded infrared light signals sent with an infrared transmitter provides a signature signal substantially longer in duration than abrupt changes in lighting conditions to achieve improved performance in indoor light and direct and indirect sunlight. The infrared receiver includes at least one photodiode for detecting infrared light with the photodiode being biased by an inductive current source presenting a substantially higher alternating current than direct current circuit impedance to limit current changes from abrupt changes in lighting to avoid saturating the receiver.

Briefly summarized, the present invention relates to a gun apparatus facilitating a game of tag using infrared light communications between a plurality of players. An electronic controller is coupled to a transmitter for sending a series of encoded infrared light signals and a receiver for detecting infrared light signals. A gun body enclosing the controller includes a handle with at least one hand operable trigger switch and a housing attached to the handle which may be conformed to the player's wrist and forearm. The housing has a front end portion forward of the handle for positioning an infrared light lens for focussing the series of encoded infrared light signals from the transmitter outwardly from the housing. The trigger switch may be operable with the controller for inhibiting the receiver for a predetermined period of time. Alternatively, a plurality of such switches may be provided as being operable in combination for either inhibiting said receiver for a predetermined period of time, or for sending a special function encoded infrared light signal, e.g., representative of a multiplicity of said series of encoded infrared light signals.

Other objects and advantages of the present invention will become apparent to one of ordinary skill in the art, upon a perusal of the following specification and claims in light of the accompanying drawings.

DESCRIPTION OF THE PREFERRED EMBODIMENTS

Figure 1:
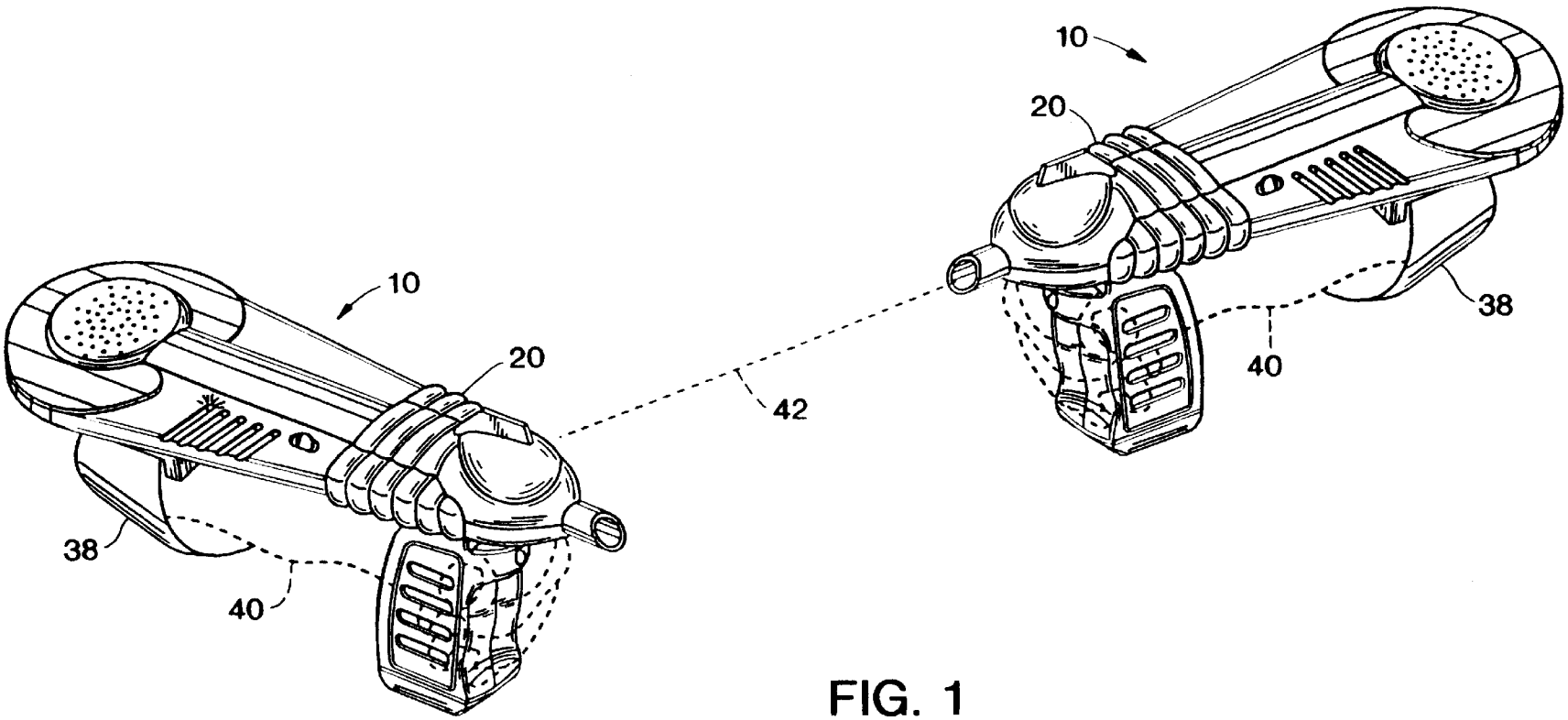
FIG. 1 is a perspective view of a pair of gun and target apparatus for facilitating a game of tag using infrared light communications between a plurality of players shown with each player being equipped with the gun and target according to the present invention.
Figure 2:
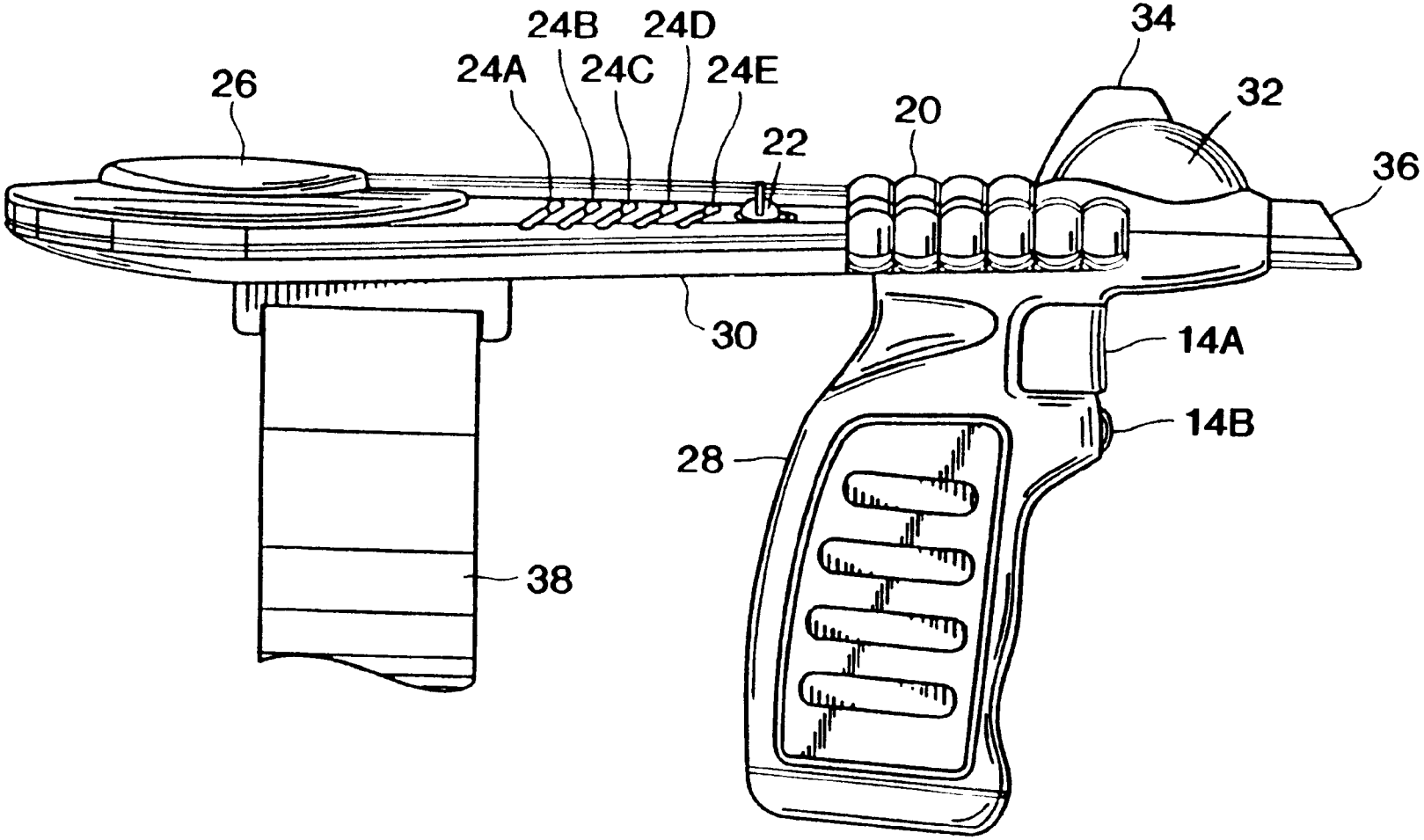
FIG. 2 is a side view of the hand-held electronic game apparatus 10 of FIG. 1 embodying the present invention.
Figure 2A:
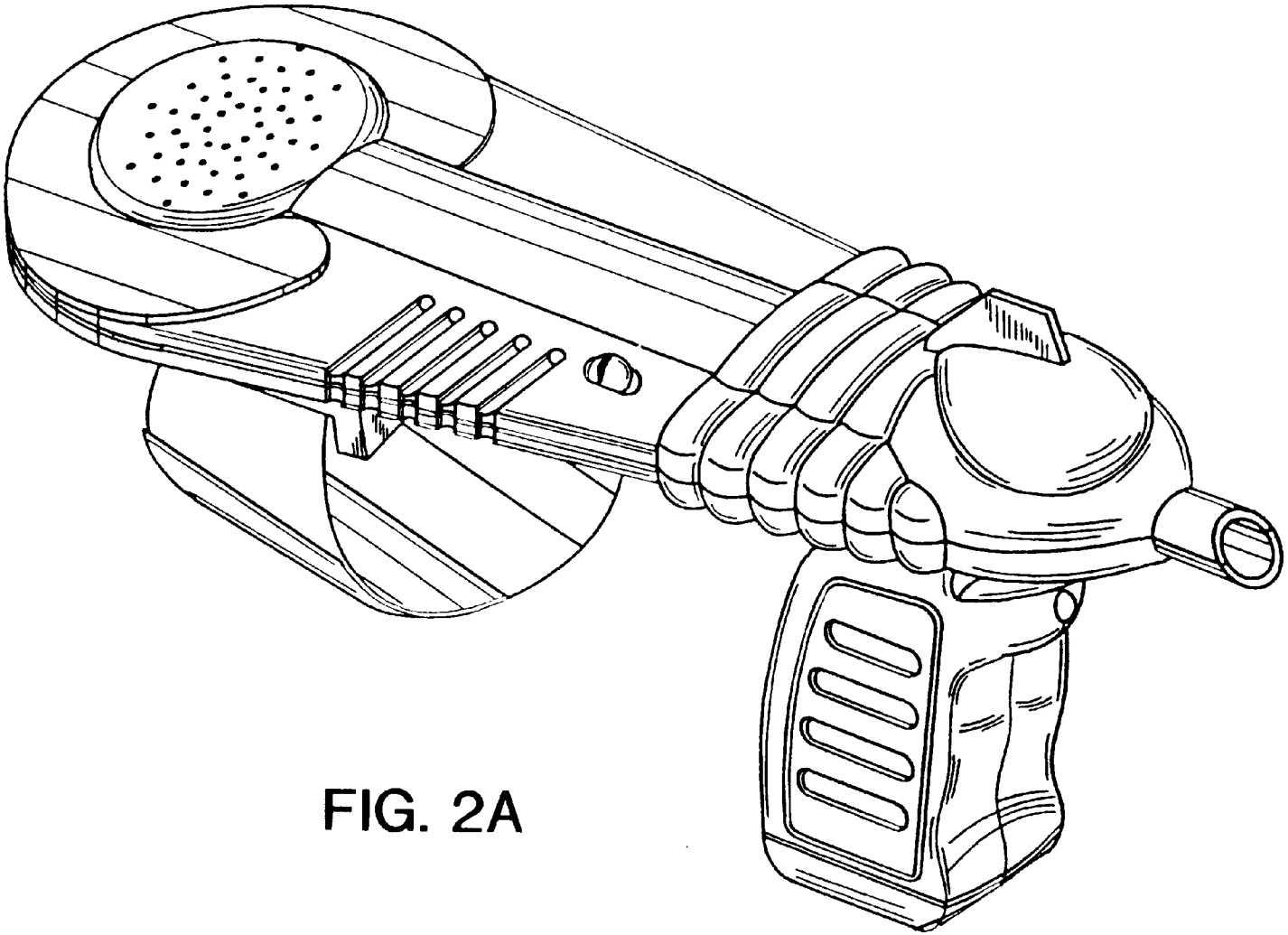
FIGS. 2A–G present perspective, top, bottom, left, right, front, and back views of the hand-held electronic game apparatus respectively.
Figure 2B:
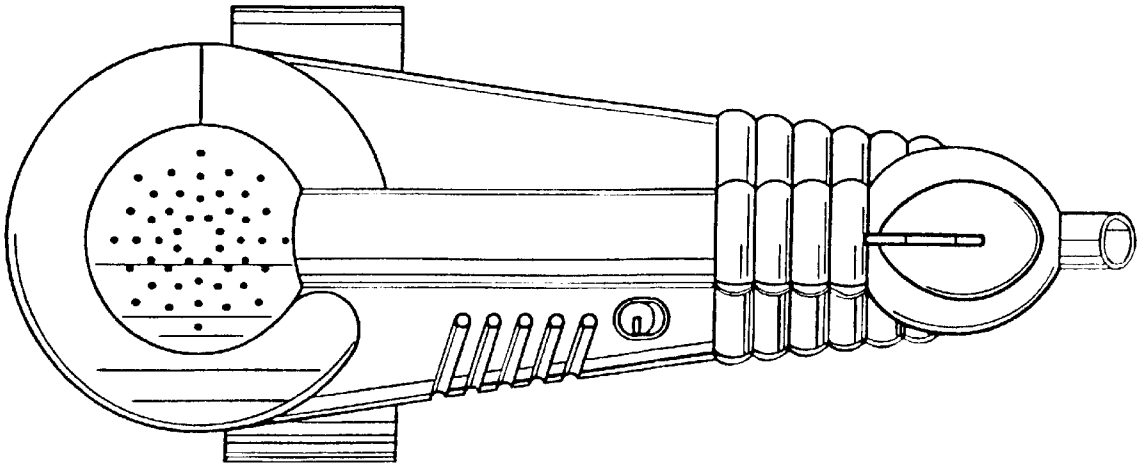
Figure 2C:
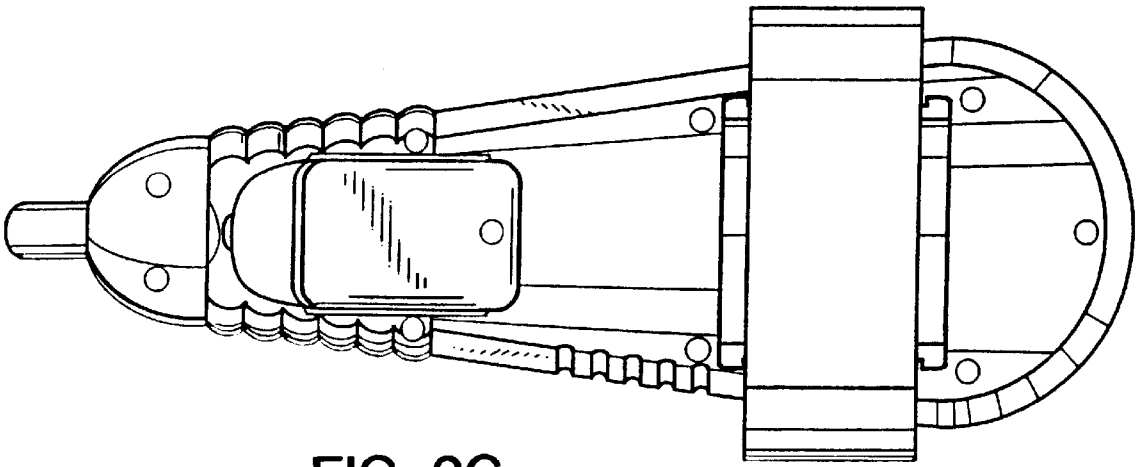
Figure 2E:
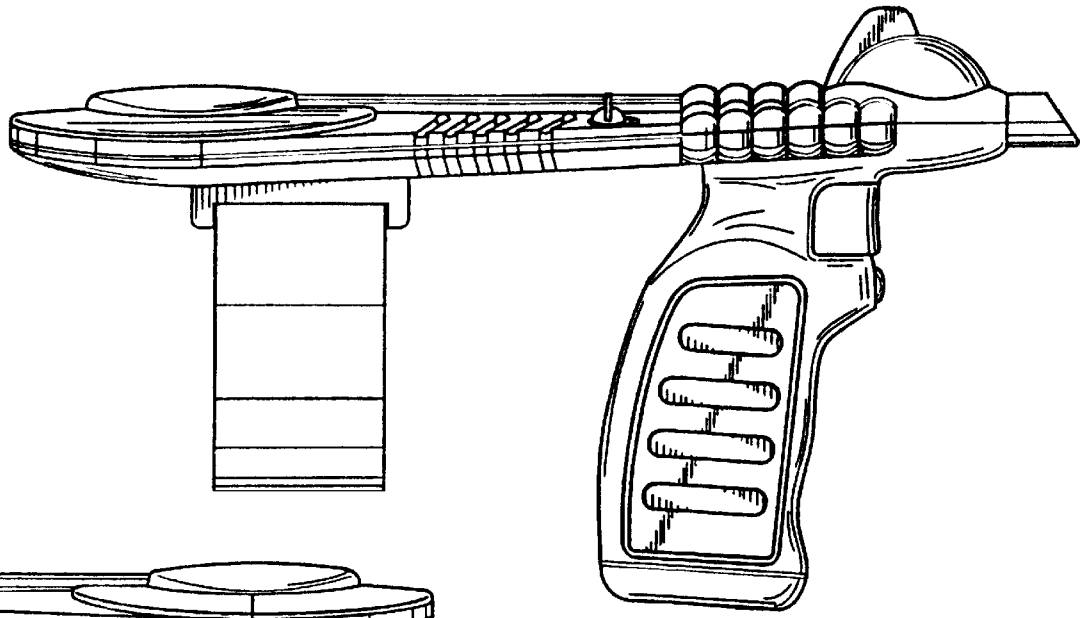
Figure 2D:
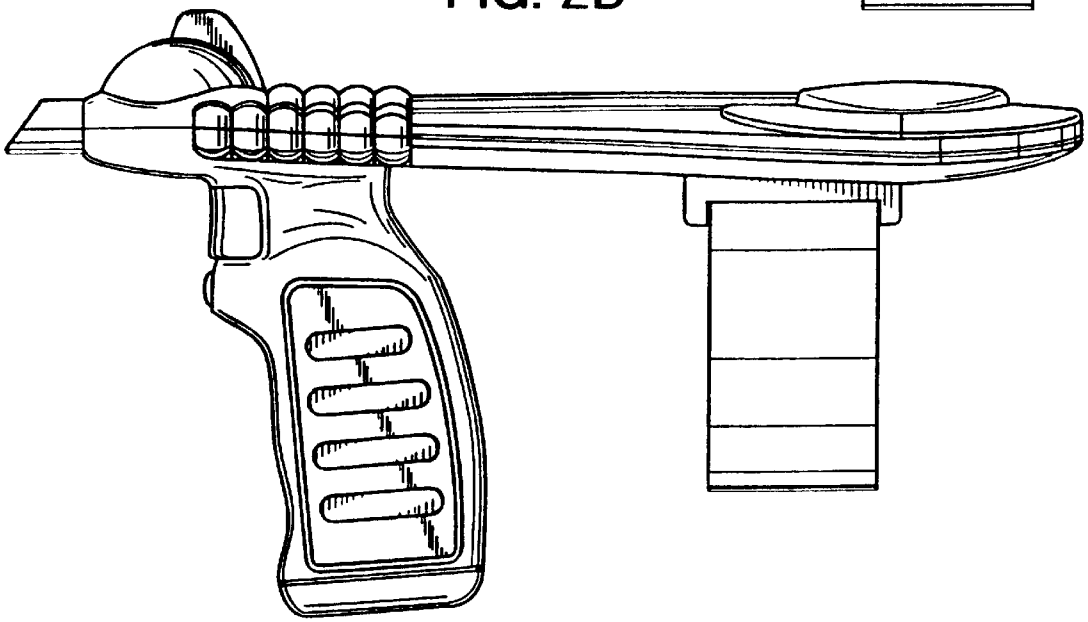
Figure 2G:
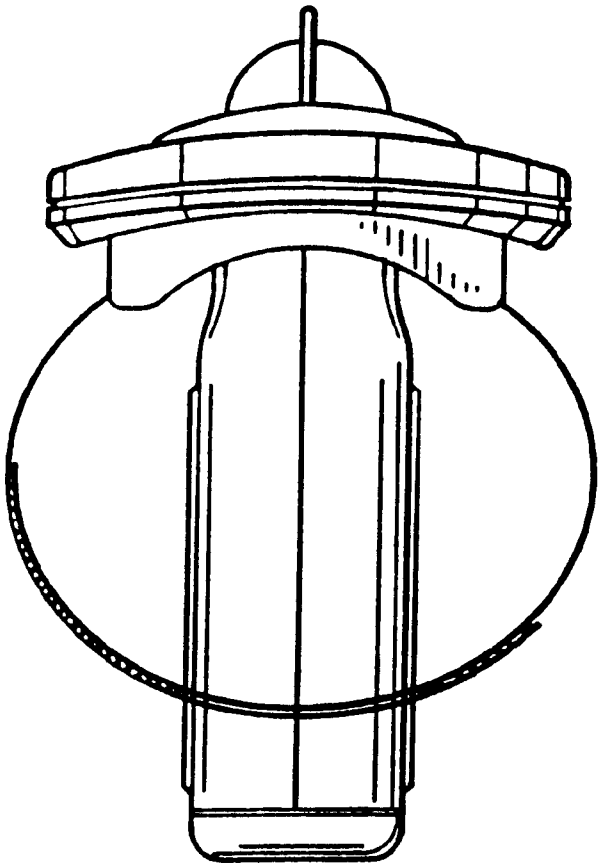
Figure 2F:
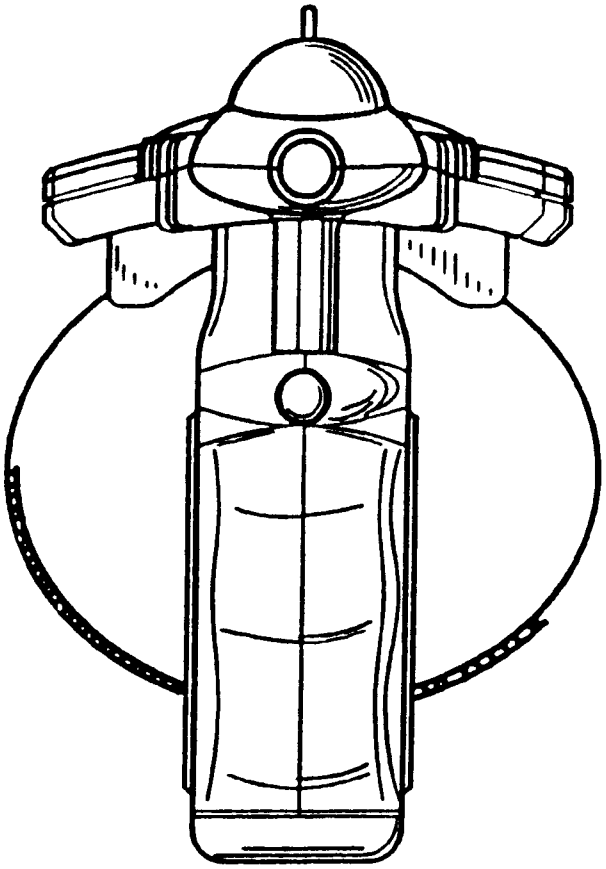

Referring now the drawings and especially to FIGS. 1 and 2, gun and target apparatus for facilitating a game of tag using infrared light communications between a plurality of players is shown with each player being equipped with the gun and target, the hand-held electronic game apparatus embodying the present invention is generally shown and identified by numeral 10. The apparatus 10 described herein includes a gun body 20, which as in the schematic drawing of FIG. 6, encloses an electronic controller 12 provided as a microcomputer herein from the SM5 family of single-chip, four bit microcomputers available from Sharp Corporation, Japan, but any appropriate microcontroller or microprocessor may be employed in the described embodiment. The described gun and target apparatus for facilitating a game of tag using infrared light communications between a plurality of players described herein equips each player with a gun and target combination which includes at least one hand operable trigger, herein trigger 14A and special effects button 14B, coupled to the controller 12. Additional input switches may be employed for communication between the player and the controller 12. A transmitter 16 indicated by dash lines is coupled to the controller 12 for sending a series of encoded infrared light signals responsive to the trigger 14A and/or 14B, wherein the infrared light signals are indicated in FIG. 1 by dashed line 42. An infrared receiver 18 as indicated in the dashed line circuitry section of FIG. 6, coupled to the controller 12, detects the infrared light signals 42 from the apparatus 10.

As shown in FIG. 2, the gun body 20 provides an on-off switch 22, and several indicator lights 24A–24E which may be used for scoring as described below. A speaker 26 is positioned in the gun body 20 wherein the controller 12 includes a sound generator for generating audio effects responsive to the transmitter 16, the receiver 18 and the hand operable trigger switches 14A and 14B coupled to the controller 12.

The gun body 20 enclosing the controller 12 includes a handle 28 for supporting the hand operable trigger switches 14A and 14B, and the gun body 20 also includes a housing 30 atop the handle 28 which as shown conforms to the player's wrist and forearm with a VELCRO e.g., hook and loop type fastener material strap 38 plus securing the player's forearm and hand shown in broken lines as reference numeral 40 in FIG. 1, for operation of the apparatus 10. The side view of FIG. 2 also shows a target window 32 having a non-planar surface which includes upstanding target sight 34 for aiming the gun and target apparatus 10. An infrared lens 36 at a forward end portion of the gun housing 22 is used to focus infrared light transmitted from the transmitter 16 away from the gun body 20.

Figure 3A:
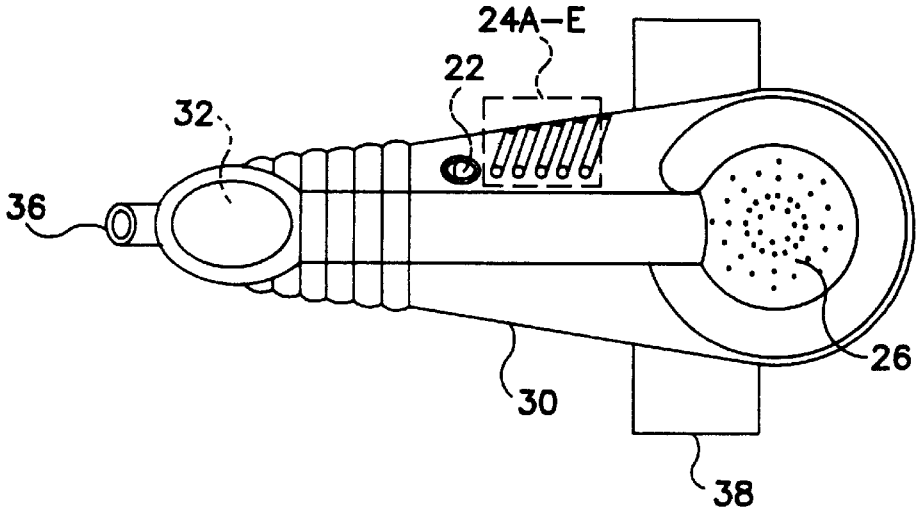
FIG. 3A is a top plan view of the hand-held electronic game apparatus.

Turning now to FIG. 3A, a top plan view of the hand-held electronic game apparatus 10 shows the target window 32 at the forward end of the housing 30 near the infrared light lens 36. Thus, the housing 30 includes a top portion for mounting the non-planar surface of the target window 32 for exposing the target window upwardly and outwardly over a wide range of side angles, herein providing a 360 degree infrared light sensor for allowing hits from infrared light from other apparatus 10 to be detected from 360 degrees around the player. The non-planar target window 32 is typically an infrared light filtering material for passing infrared light and filtering extraneous background light, but the target window may also be suited for providing a light indicator for indicating when a hit is received, so as to integrate the target window with a hit indicator which may be observed by the player. As described, the housing 30 further includes a front end portion for the handle 28 for positioning the infrared light lens 36 for focusing the series of encoded infrared light signals 42 from the transmitter 16 outwardly from the housing 30.

Figure 3B:
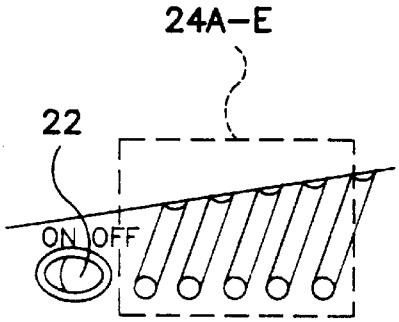
FIG. 3B is an exploded view of the scoring indicator lights of FIG. 3A.

Scoring for the game is indicated by the five (5) red LED's, 24A–24E shown in the exploded view of FIG. 3B on the top of the unit. During normal play, the LED's will flash sequentially. As described, the apparatus 10 includes a plurality of visual indicators 24A–24E coupled to the electronic controller 12 responsive to the encoded infrared light signals 42 detected at the receiver 18. Thus, a method of facilitating a game of tag using infrared light communications between a plurality of players is described wherein each player is equipped with the transmitter 16 which sends a series of encoded infrared light signals 42 towards another player. The method includes associating a target 32 with each player having a receiver 18 for detecting the encoded infrared light signals 42 from each of the other players. Further, the gun body 40 provides for the transmitter at 16 and the receiver 18 and target 32 in combination.

Thus, using the LED light indicators of reference numerals 24A–E provide a method wherein the counting of the number of encoded infrared light signals 42 detected from other players is performed. Hereafter, a disabling of the transmitter 18 from sending the series of infrared light signals 42 towards another player is performed responsive to the predetermined count of received encoded infrared light signals being detected from other players in the provided counting step described above. A typical game plan will be provided as follows, e.g., two (2) "hits" to eliminate one "life." Each single LED represents two (2) lives. The first hit changes the LED to a solid ON nearest the front of the unit. The third hit changes the second LED to solid on. The fifth hit changes the third LED to solid on. The game continues this way until 10 hits then the unit will indicate a game over and the LED's will turn off. Once a player has been hit, e.g., 10 times, the unit will not function until it is turned off and then on again. If the player does not turn the unit off, it will beep periodically to remind the player to turn it off.

Figure 3C:
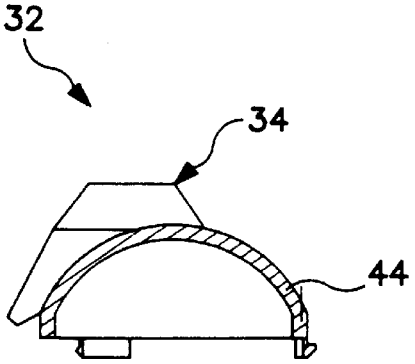
FIGS. 3C and 3D are exploded cross-sectional views of the arcuate target window of FIG. 3A.
Figure 3D:
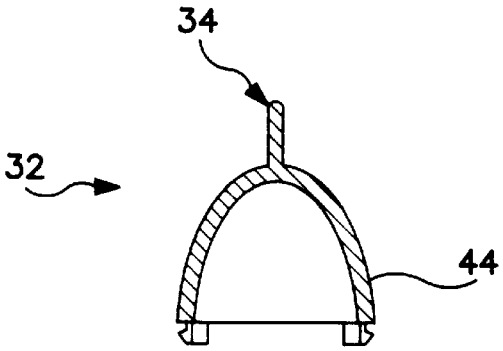

FIGS. 3C and 3D are exploded cross-sectional views of the target window 32. Herein, the non-planar surface of the target window 32 is provided as an arcuate surface 44. As described, the target window 32 may be constructed from a tinted filter material which passes infrared light. The infrared receiver 16 is thus positioned behind the target window 32 and as described below may include a plurality of photodiodes for detecting the infrared light over a wide range of angles. As described, the receiver 16 may include three (3) photodiodes for detecting infrared light over 360 degrees. The arcuate surface 44 of the target window 32, as will be appreciated below, positions the receiver 18 for exposure to light upwardly and outwardly over a wide range of angles.

Figure 4A:
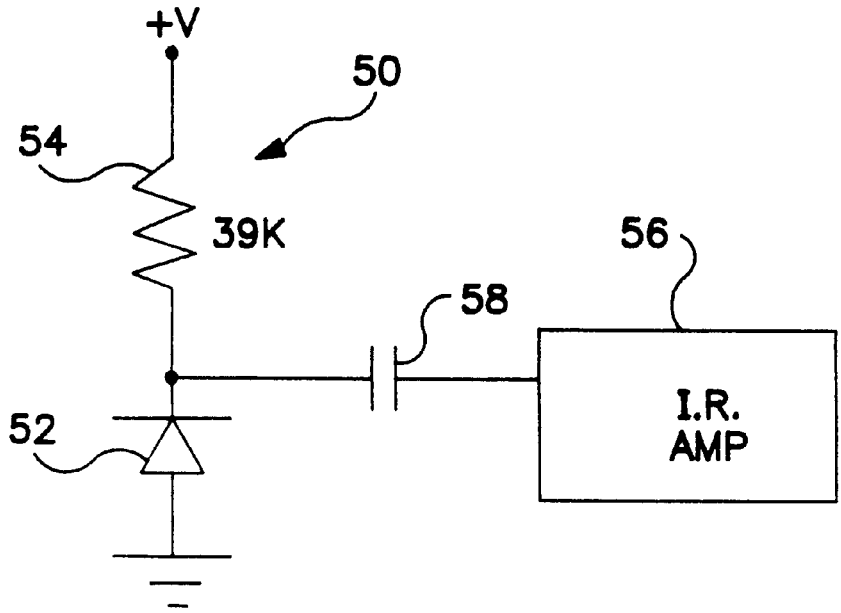
FIG. 4A is a prior art infrared photodiode receiver circuit.
Figure 4B:
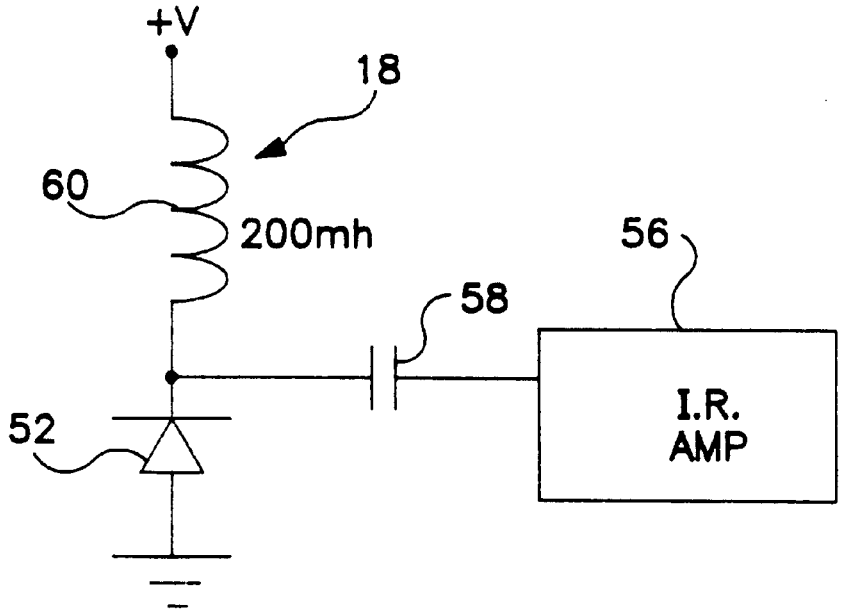
FIG. 4B is a infrared photodiode receiver circuit employing an inductive current source in accordance with the invention.

FIG. 4A shows a prior art infrared photodiode receiver circuit 50 in which a photodiode 52 is biased by a resister 54, e.g., 39 KHz, and a capacitively coupled to an infrared amplifier 56 by a capacitor 58. The prior art receiver circuit 50 typically provides a direct current biased resistance of 38 KHz and an alternating current load of 39 KHz as well. FIG. 4B on the other hand shows receiver circuit 18 in which the photodiode 52 is biased with an inductive load, herein a 200 millihenry inductor 60.

The relatively large inductive impedance provided in the bias circuit of FIG. 4B representing the infrared receiver 18 provides a low resistive direct current biases of approximately ohms, while providing an alternating current load of approximately 37.7 KHz. Thus, the receiver 18 includes at least one photodiode 52 being biased by an inductive current source presenting a substantially higher alternating current (AC) than direct current (DC) circuit impedance to limit current changes from abrupt changes in the illumination of the photodiode 52 and to avoid driving the receiver 18 into saturation. Moreover, the target window 32 for the receiver 18 having the photodiode 52 positioned behind the target window 32 provides for the photodiode 52 being exposed upwardly as well as orderly so as to position the receiver 18 for reception of background light signals, as well as for receiving signals from other apparatus 10. Thus, the receiver 18 is suited particularly for receiving the series of encoded infrared light signals 42 sent by other apparatus 10 so as to discriminate background noise at the receiver 18.

Thus, optimal performance in both indoor light and direct and indirect sunlight is achieved with a low cost inductive bias circuit. The described techniques have been used to optimize the apparatus 10 for use in a noisy background environment. The receiver 18 uses a conventional reverse bias PIN Photodiode as the sensor. In this arrangement, current from the photodiode is transformed to an output voltage. This technique works very well when the ambient light level is relatively stable, such as typical indoor lighting. When extreme lighting conditions such as outdoor lighting are encountered, the current through the photodetector goes up very high and saturates the output because the bias resistor limits the amount of current the photodetector can draw. At the same time, high rejection of background noise is achieved. The bias resistor can be reduced to properly bias the photodiode, although the AC load on the photodiode output will be increased and this will reduce the AC output.

The typical recommended bias circuit of prior art cannot work well in bright light conditions, because one of two effects will happen (1) the output saturates due to current limit from the bias resistor, or (2) the AC output from the photodiode is poor due to bias resistor loading when the resistor value is reduced for proper bias under high light.

To solve this problem, the inductive bias circuit of FIG. 4B incorporates into the electronic game of the apparatus 10 which bias circuit uses a large inductor instead of a bias resistor. The large inductor has a high AC impedance at the center frequency of 30 KHz which minimizes the AC load and a low DC impedance of approximately 20 ohms. The DC bias circuit never becomes a current limit, therefore the photodiode remains active in all lighting conditions.

High light conditions are characterized by a high degree of infrared noise. Most infrared (IR) communication devices such as TV remote controllers, etc., operate in relatively low light environments such as indoor lighting. The IR noise figure indoors is relatively low, the IR output signal from the remote controller is much stronger than background noise and therefore random noise is typically not a problem. Outdoors in sunlight the IR background noise level is very high compared to the signal from an IR emitter.

Figure 5A:
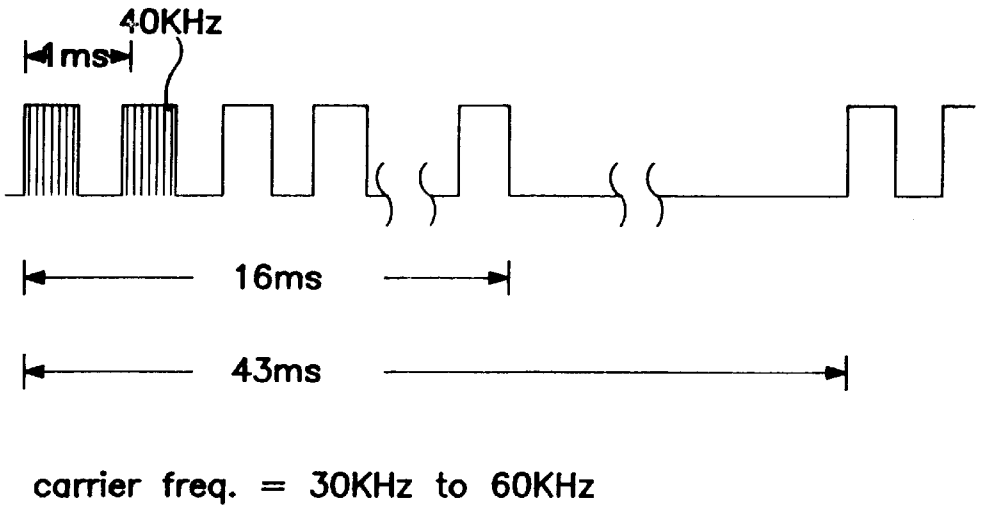
FIG. 5A is a prior art series of encoded signals for infrared data communications.
Figure 5B:
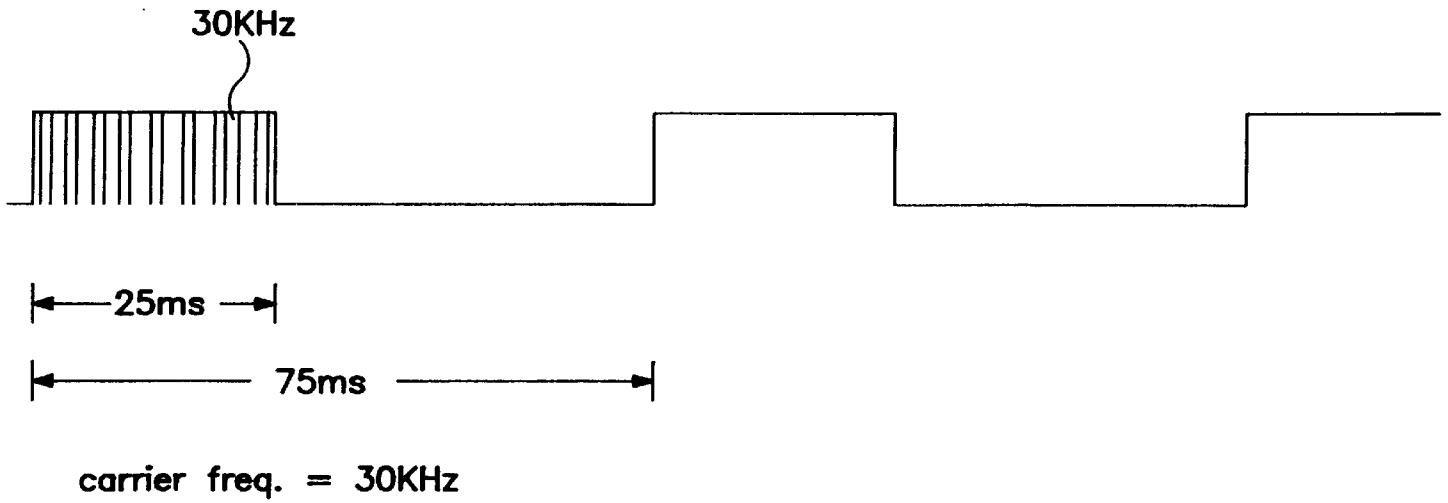
FIG. 5B is a series of encoded signals for infrared data communications according to the invention.

FIG. 5A shows the typical IR transmission signal and FIG. 5B shows used with apparatus 10. Typical IR transmission schemes send multiple bits of data within one cycle. FIG. 5A shows 16 bits of data indicated by a reference numeral 62 with a 1 ms period each, the carrier frequency is 40 KHz and the repeat period is 43 Ms. The signal used with the apparatus 10 has only 3 bits of data with a 75 ms period each. The apparatus 10 game play does not need to send large amounts of data, it simply generates an IR signature that is easily readable through background noise.

Characterizing random noise, it has been found that sunlight and some indoor lighting conditions can generate noise pulses of up to 7 ms in length. The typical IR transmission scheme cannot filter these pulses and therefore relies on repeating the pattern until a clear signal is received which, in some high noise environments, is virtually never. The electronic game of the apparatus 10 cannot rely on repeating the pattern, as this is a movement game and the target is constantly moving. One single burst, if on target, must hit, therefore an infrared light signature that could easily be detected through sunlight is used.

The electronic game's signal indicated by reference numeral 64 has the signature of FIG. 5B has a 25 ms on time of a continuous 30 KHz carrier followed by a 50 ms off time. This pattern is repeated three (3) times. IR Signature is a long period which is easily implemented with low cost, slow toy grade microprocessors. This uncharacteristically long 25 ms on period allows for the detector to easily lock onto the signal and is far removed from the period of background noise.

Figure 6A:
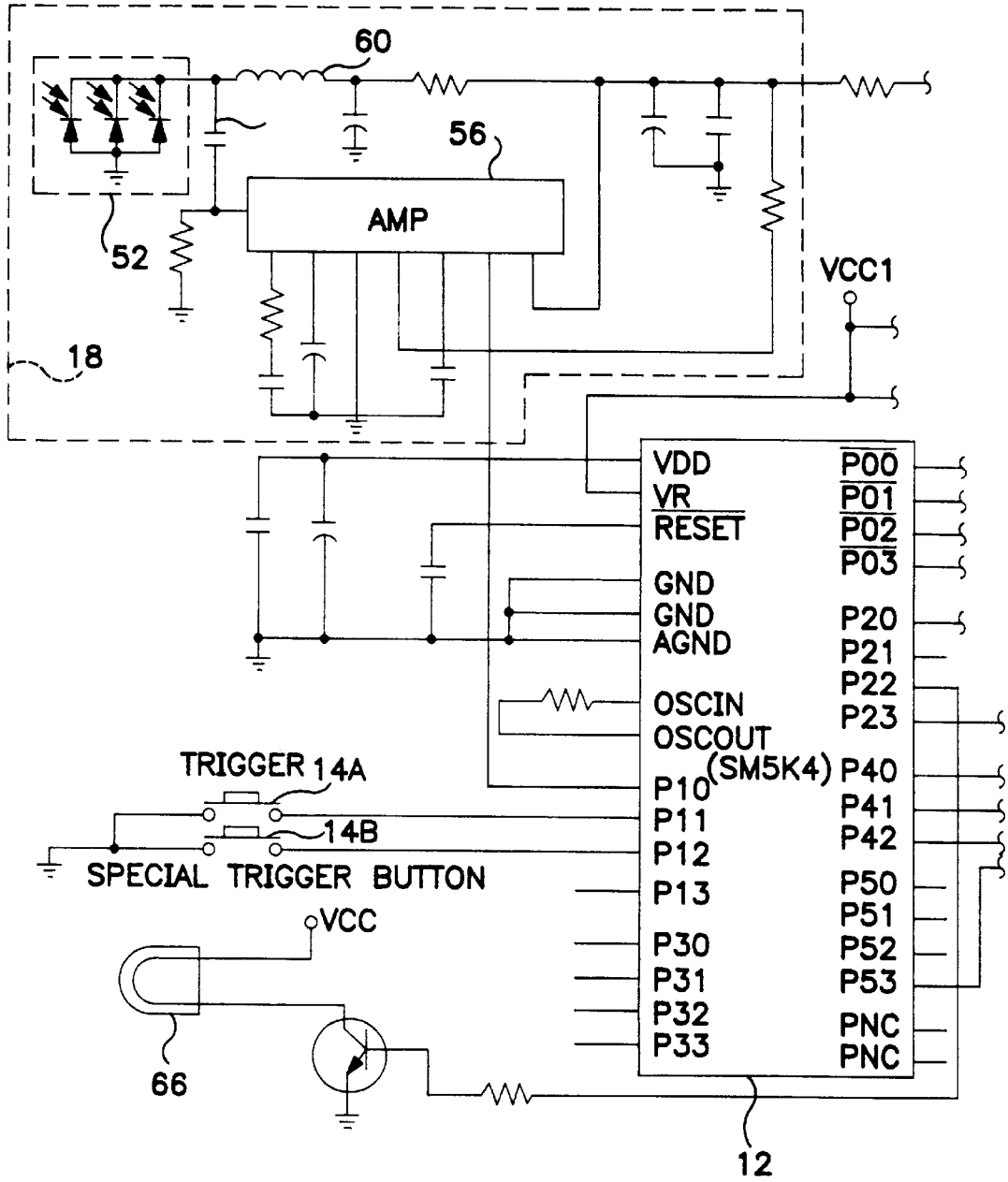
FIG. 6 is a schematic diagram of the circuitry for the gun and target apparatus using an infrared light receiver and transmitter.
Figure 6B:
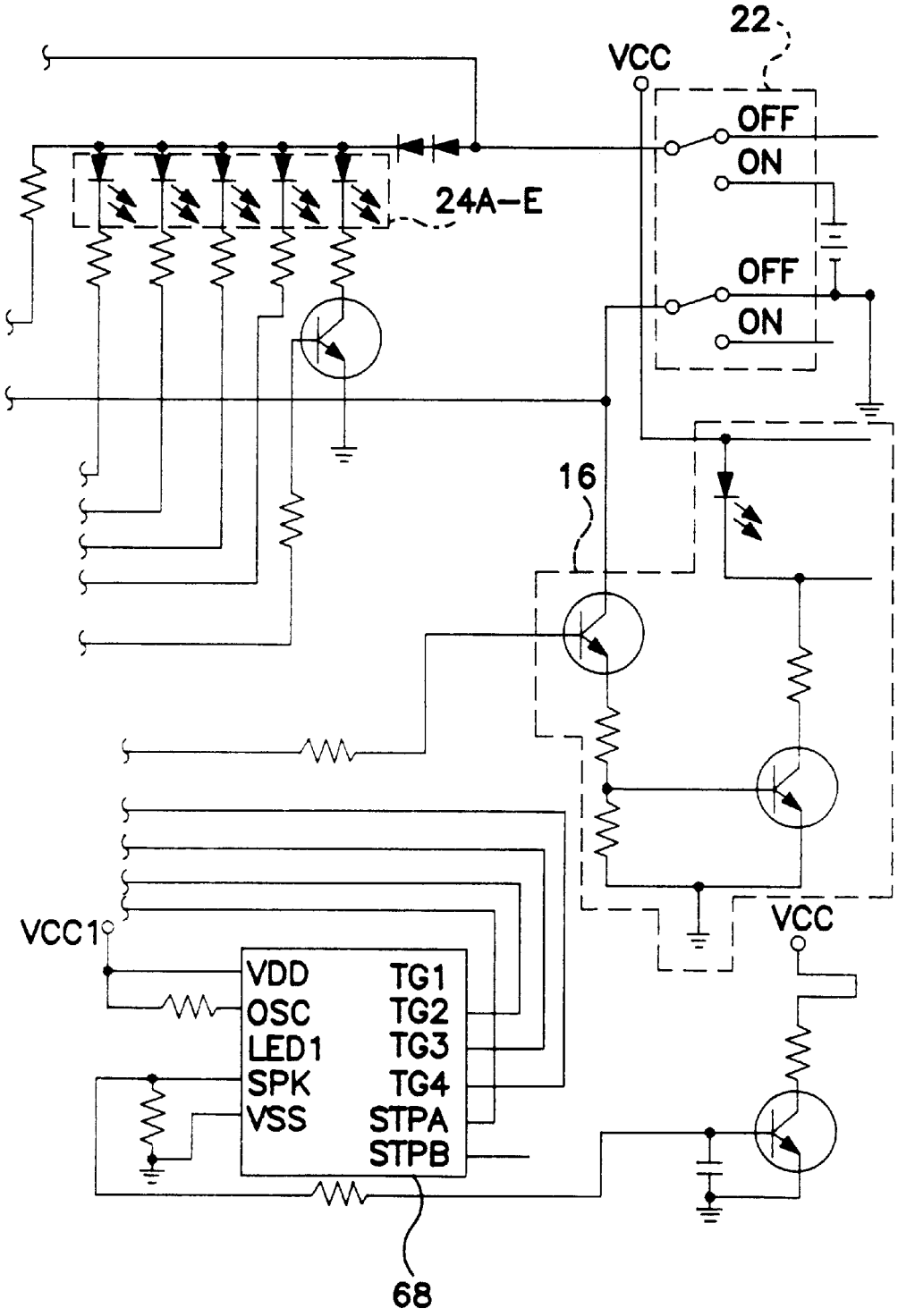

The schematic circuit diagram of FIG. 6 for the apparatus 10 shows the microcomputer 12 with the two triggers 14A and 14B that are attached to the handle of the apparatus 10. The main trigger 14A activates infrared data transmission while the special effects button 14B, the secondary trigger, activates various special features, described further below. Trigger switches 14A and 14B are coupled to the microcomputer 12 via port one as shown in FIG. 6. Visual indicators 24A–24E, herein light emitting diodes are also coupled to ports of the microcomputer 12, herein port 0 and port 2. Port 2 of the microcomputer 12 is also used as an output for the transmitter 16 of the apparatus 10.

The receiver 16 as shown in FIG. 6 includes three (3) photodiodes indicated in dash lines by reference numeral 52 which are by the 200 millihenry inductor 60 as discussed above. The three (3) photodiodes cover 360 degrees infrared reception and are coupled to an infrared amplifier via capacitor 58. The infrared amplifier 56, herein KA2184, is a conventional electronic amplifier for use with the receiver circuit 18 to provide a digital output to port 0 of the microcomputer 12 for receiving the infrared coded data at the apparatus 10. Under digital control of the microcomputer 12, the input and output port may be used to provide several features for inhibiting and/or enhancing receiver 18 and transmitter 16 operation, as described further below.

The electronic game of the apparatus 10 has several features including a "Shields" feature and a "Mega Blast" feature. The Shields feature allows a player to effectively block a predetermined number of incoming hits or tags for a predetermined period of time, and send multiple signals or codes representing multiple signals. For example, three shields per game, each lasting three seconds, has been found to be satisfactory for the game play. Variations on these two parameters of the Shields feature are within the scope of the invention. The Mega Blast feature allows a player to tag out an opposing player with one hit. In a preferred embodiment, the electronic game counts up to ten hits. The Mega Blast feature will deliver ten hits at once to tag a player out.

The switch 22 shown in FIG. 6 is provided as a double pull double throw switch for coupling the battery power to the apparatus 10 such that transmitter 16 and receiver 18 circuits are grounded when the switch 22 is in its off position. FIG. 6 also shows the visual and audio effects provided for the apparatus 10 when either the transmitter 16 via trigger 14A and/or 14B emit infrared signals with associated sound effects or the receiver 18 indicating the reception of infrared signals with corresponding audio visual effects for the player. More particularly, an incandescent light bulb 66 is driven by port 2 of the microcomputer 12 via a transistor, and a sound effects chip 68 coupled to ports 4 and 5 of the microcomputer 12 provide audio output to the speaker 26. A wide variety of the audio effects chips may be employed for providing several different audio effects associated with the use of the apparatus 10.

To turn the apparatus 10 on, the player slides the ON/OFF switch 22 to the ON position. Sound effects indicate that the unit is power up. To emit a single infrared (laser) strike, press and release the main trigger 14A once. To emit a rapid continuous strike, press and hold the main trigger 14A. The rapid/continuous strike may only be used for, e.g., five seconds at a time. After, e.g., five seconds, the unit will only be able to emit a single strike for, e.g., ten seconds.

The Super Strike is a single strike with the power of ten (10) regular strikes. To activate Super Strike the player presses the regular trigger 14A and the special feature trigger 14B at the same time. A player may, e.g., only use Super Strike once during a game so make sure it is used wisely. If Super Strike misses, e.g., it may not be used again.

The Force Field allows a player to "block" a laser strike and avoid a "hit" from an opponent. To activate Force Field the player presses the special feature trigger 14B. The Force Field is activated for, e.g., three seconds during which your unit is shielded from any opponents. The FORCE FIELD may only be used, e.g., three times during a game.

As discussed, the trigger 14A, and particularly the special effects button 14B are used in the embodiment to provide the target 32 including the receiver 18 for detecting the infrared light signals 42 such that the target 32 is responsive at least one of the switches, i.e., special effect button 14B. Accordingly, at least one of the trigger switches 14A and/or 14B is operable with the controller herein microcomputer 12 for inhibiting the receiver 18 for a predetermined period of time.

Additionally, a plurality of such switches 14A and 14B may be operable in combination for inhibiting the receiver 18 for the predetermined period of time. As described above, the switches 14A and 14B are further operable for sending either an encoded infrared light signal 42 representative of a multiplicity of a series of encoded infrared light signals 42, and/or for sending a multiplicity of the series of encoded infrared light signals 42. To this end, the particular encoding of the several states of the encoded infrared light signal 42 may be itself representative of multiple such signals, or several signals may be transmitted through the combined operation of the triggers 14A and 14B.

While there have been illustrated and described particular embodiments of the invention, it will be appreciated that numerous changes and modifications will occur to those skilled in the art, and it is intended in the appended claims to cover all those changes and modifications which fall within the true spirit and scope of the invention.

What is claimed is:

1. An apparatus for facilitating a game of tag using infrared light communications between a plurality of players, comprising:

an electronic controller;

at least one switch coupled to said controller for generating a plurality of game functions;

a transmitter coupled to said controller for sending a series of encoded infrared light signals responsive to said at least one switch;

an infrared light lens;

a gun body enclosing said controller comprising a handle and a housing attached to said handle including said at least one switch, said housing comprising a front end portion forward of said handle for positioning said infrared light lens for focussing the series of encoded infrared light signals from said transmitter outwardly from said housing; and a target comprising a receiver for detecting infrared light signals, said target being responsive to said at least one switch wherein said at least one switch is operable with said controller and said transmitter for sending an encoded infrared light signal representative of a multiplicity of said series of encoded infrared light signals.

2. An apparatus as recited in claim 1 wherein said at least one switch is operable with said controller for inhibiting said receiver for a predetermined period of time.

3. An apparatus as recited in claim 2 comprising a plurality of switches operable in combination for inhibiting said receiver for a predetermined period of time.

4. An apparatus as recited in claim 1 comprising a plurality of switches operable in combination for sending said series of encoded infrared light signals.

5. An apparatus as recited in claim 1 wherein said at least one switch is operable with said controller and said transmitter for sending a multiplicity of said series of encoded infrared light signals.

6. An apparatus as recited in claim 5 wherein said at least one switch comprises a hand operable trigger coupled to said controller for sending a series of encoded infrared light signals responsive to said trigger.

7. An apparatus as recited in claim 1 wherein said target is mounted on said gun body housing.

8. An apparatus as recited in claim 7 wherein said target comprises a target window having a non-planar surface, and said gun body housing comprises a top portion for mounting the non-planar surface of said target window for exposing said target window upwardly and outwardly over a wide range of side angles.

9. An apparatus as recited in claim 7 wherein said gun body housing is positioned atop said handle.

10. A gun and target apparatus for facilitating a game of tag using infrared light communications between a plurality of players, each player being equipped with the gun and target, said apparatus comprising:

an electronic controller;

at least one hand operable trigger coupled to said controller;

a transmitter coupled to said controller for sending a series of encoded infrared light signals responsive to said trigger;

a receiver coupled to said controller for detecting infrared light signals;

an infrared light lens;

a target window having a non-planar surface;

a gun body enclosing said controller comprising a handle including said at least one hand operable trigger and a housing atop said handle, said housing comprising a top portion for mounting the non-planar surface of said target window for exposing said target window upwardly and outwardly over a wide range of side angles, said housing further comprising a front end portion forward of said handle for positioning said infrared light lens for focussing the series of encoded infrared light signals from said transmitter outwardly from said housing; and said receiver comprising at least one photodiode for detecting infrared light, said photodiode being biased by an inductive current source presenting a substantially higher alternating current than direct current circuit impedance to limit current changes from abrupt changes in the illumination of said photodiode and to avoid driving said receiver into saturation.

11. An apparatus as recited in claim 10 wherein said series of encoded infrared light signals sent by said transmitter provides a signature signal substantially longer in duration than abrupt changes in the illumination from background noise to discriminate the encoded infrared signals from the background noise at said receiver.

12. An apparatus as recited in claim 10 wherein the non-planar surface of said target window comprises an arcuate surface.

13. An apparatus as recited in claim 12 wherein said target window comprises a tinted filter material which passes infrared light.

14. An apparatus as recited in claim 13 wherein said receiver comprises a plurality of photodiodes for detecting infrared light over a wide range of side angles.

15. An apparatus as recited in claim 14 wherein said receiver comprises at least three photodiodes for detecting infrared light over 360 degrees.

16. An apparatus as recited in claim 12 comprising a second hand operable trigger coupled to said controller for generating a plurality of separate game functions.

17. An apparatus as recited in claim 16 wherein said second hand operable trigger is operable with said controller for inhibiting said receiver for a predetermined period of time.

18. An apparatus as recited in claim 16 wherein said second hand operable trigger is operable with said controller and said transmitter for sending a multiplicity of said series of encoded infrared light signals.

19. An apparatus as recited in claim 16 wherein said electronic controller comprises a sound generator for generating audio effects responsive to any of said transmitter, receiver and hand operable triggers coupled to said controller.

20. An apparatus as recited in claim 10 comprising a plurality of visual indicators coupled to said electronic controller responsive to the encoded infrared light signals detected at said receiver.

21. An apparatus as recited in claim 10 wherein said housing atop said handle conforms to the player's wrist and forearm and comprises a hook and loop type fastener material strap for securing said gun body to the player's arm.

22. A target apparatus for facilitating a game of tag using infrared light communications between a plurality of players, each target apparatus comprising:

an electronic controller;

a receiver coupled to said controller for detecting infrared light signals;

a target window having a non-planar surface;

an enclosure for said controller comprising a contoured surface conforming to the player's person, said enclosure comprising a top portion for mounting the non-planar surface of said target window for exposing said target window upwardly and outwardly over a wide range of side angles; and said receiver comprising at least one photodiode for detecting infrared light, said photodiode being biased by an inductive current source presenting a substantially higher alternating current than direct current circuit impedance to limit current changes from abrupt changes in the illumination of said photodiode and to avoid driving said receiver into saturation.

23. An apparatus as recited in claim 22 wherein said enclosure comprises a body enclosing said controller comprising a handle and a housing atop said handle conforming to the player's wrist and forearm, said housing comprising a top portion for mounting the non-planar surface of said target window for exposing said target window upwardly and outwardly over a wide range of side angles.

24. An apparatus as recited in claim 23 wherein the non-planar surface of said target window comprises an arcuate surface.

25. An apparatus as recited in claim 24 wherein said receiver comprises a plurality of photodiodes for detecting infrared light over a wide range of side angles.

26. A method of facilitating a game of tag using infrared light communications between a plurality of players, comprising the steps of:

equipping each player with a transmitter for sending a series of encoded infrared light signals towards another player;

associating a target with each player having a receiver for detecting the encoded infrared light signals from each of the other players;

providing a gun body for the transmitter and the target in combination with a handle including at least one hand operable trigger and a housing atop the handle conforming to the player's wrist and forearm such that a top portion of the housing secures a non-planar surface target window exposed upwardly and outwardly over a wide range of side angles;

positioning an infrared light lens at a front end portion of the housing for focussing the series of encoded infrared light signals from the transmitter outwardly from the gun body housing; and coupling the at least one hand operable trigger to the transmitter with an electronic controller for sending an encoded infrared light signal representative of a multiplicity of the series of encoded infrared light signals through the encoding of the several states of the encoded infrared light signal.

27. A method as recited in claim 26, further comprising the steps of:

counting the number of encoded infrared light signals detected from other players; and disabling the transmitter from sending the series of encoded infrared light signals towards another player responsive to a predetermined count of received encoded infrared light signals being detected from other players in said counting step.

28. A method as recited in claim 26, further comprising the step of providing the at least one hand operable trigger as a plurality of switches operable in combination for sending the series of encoded infrared light signals.

29. A method as recited in claim 26, wherein the associating step comprises providing a photodiode for detecting infrared light at the receiver, the photodiode being biased by an inductive current source presenting a substantially higher alternating current than direct current circuit impedance to limit current changes from abrupt changes in the illumination of the photodiode and to avoid driving the receiver into saturation.

30. A method as recited in claim 26, further comprising the step of transmitting the series of encoded infrared light signals sent by the transmitter as a signature signal substantially longer in duration than abrupt changes in the illumination from background noise to discriminate the encoded infrared signals from the background noise at the receiver.

* * * * *